US011952670B1

(12) United States Patent
Lenar

(10) Patent No.: US 11,952,670 B1
(45) Date of Patent: Apr. 9, 2024

(54) ANODE MOUNTING HEAD FOR HEATER TREATERS AND OTHER DEVICES

(71) Applicant: GALVOTEC ALLOYS, INC., McAllen, TX (US)

(72) Inventor: James Lenar, McAllen, TX (US)

(73) Assignee: GALVOTEC ALLOYS, INC., McAllen, TX (US)

( * ) Notice: Subject to any disclaimer, the term of this patent is extended or adjusted under 35 U.S.C. 154(b) by 448 days.

(21) Appl. No.: 17/024,504

(22) Filed: Sep. 17, 2020

Related U.S. Application Data

(60) Provisional application No. 62/901,738, filed on Sep. 17, 2019.

(51) Int. Cl.
*C23F 13/16* (2006.01)
*C23F 13/18* (2006.01)
*C23F 13/20* (2006.01)

(52) U.S. Cl.
CPC ..... *C23F 13/16* (2013.01); *C23F 13/18* (2013.01); *C23F 13/20* (2013.01)

(58) Field of Classification Search
CPC .. C23F 13/02–13/22; C23F 2213/30–2213/32; F24H 9/40–9/457
See application file for complete search history.

(56) References Cited

U.S. PATENT DOCUMENTS

| | | | | |
|---|---|---|---|---|
| 629,092 | A | 7/1899 | Ross | |
| 2,805,987 | A | 9/1957 | Thorn, Jr. et al. | |
| 3,046,213 | A | 7/1962 | Bender | |
| 3,058,086 | A | 10/1962 | Zwangzig | |
| 3,138,549 | A * | 6/1964 | Adair | C23F 13/18 204/196.18 |
| 3,616,421 | A | 10/1971 | Mackintosh | |
| 3,956,819 | A | 5/1976 | Augeri | |
| 4,136,001 | A * | 1/1979 | Nozaki | C23F 13/02 204/196.08 |
| 5,503,727 | A | 4/1996 | Jean et al. | |
| 6,606,452 | B1 * | 8/2003 | Caine | H05B 3/78 392/441 |
| 2002/0055761 | A1 | 5/2002 | Mann et al. | |
| 2007/0029191 | A1 | 2/2007 | Sewell | |
| 2009/0179025 | A1 * | 7/2009 | Knoeppel | F24H 9/455 29/610.1 |
| 2009/0188787 | A1 * | 7/2009 | Closset | C23F 13/18 204/196.37 |
| 2014/0334807 | A1 * | 11/2014 | Farris | H05B 1/0269 219/494 |

OTHER PUBLICATIONS

Bolt Depot (Hex nuts, Zinc plated grade 5 steel, 1/4"-20, 2012). (Year: 2012).*
Bolt Depot (Hex bolts, Hot dipped galvanized steel, 3/4"-10 × 20", 2014). (Year: 2014).*
Merriam Webster ("Handle", 2006) (Year: 2006).*

* cited by examiner

*Primary Examiner* — Alexander W Keeling
(74) *Attorney, Agent, or Firm* — Garvey, Smith & Nehrbass, Patent Attorneys, L.L.C.; Charles C. Garvey, Jr.; Julie Rabalais Chauvin

(57) ABSTRACT

The present invention relates to a removable and reusable anode mounting head for use with heater treaters, tanks, pressure vessels and production vessels. More particularly, the present invention provides a reusable anode mounting head with metallic and non-metallic components that enable electrical connection to the vessel and insulation at a connection to the vessel (e.g., via coupling).

25 Claims, 18 Drawing Sheets

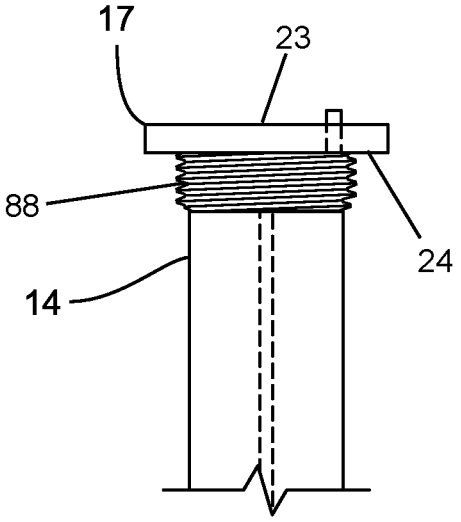
FIG. 4
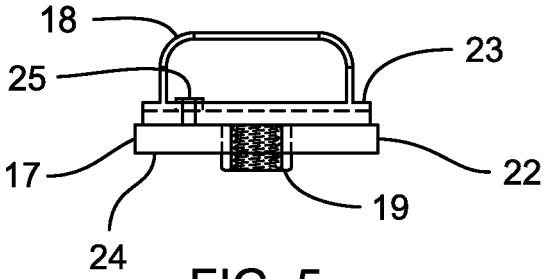
FIG. 5
FIG. 6
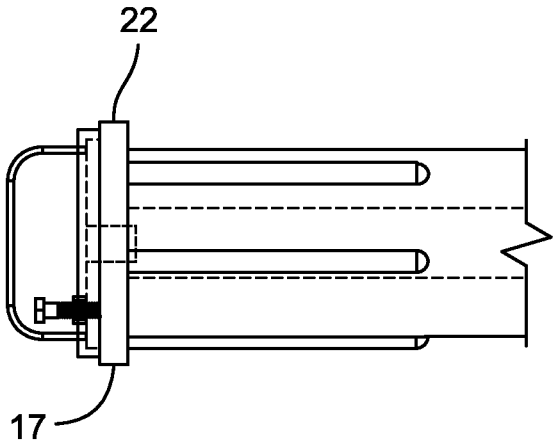
FIG. 7
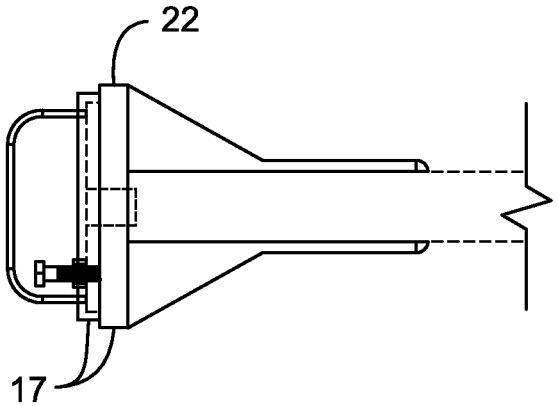

ANODE MOUNTING HEAD FOR HEATER TREATERS AND OTHER DEVICES

CROSS-REFERENCE TO RELATED APPLICATIONS

This application claims the benefit of U.S. Provisional Patent Application Ser. No. 62/901,738, filed on 17 Sep. 2019, which is incorporated herein by reference. Priority of U.S. Provisional Patent Application Ser. No. 62/901,738, filed on 17 Sep. 2019 is hereby claimed.

STATEMENT REGARDING FEDERALLY SPONSORED RESEARCH OR DEVELOPMENT

Not applicable

REFERENCE TO A "MICROFICHE APPENDIX"

Not applicable

BACKGROUND OF THE INVENTION

1. Field of the Invention

The present invention relates to a removable and reusable anode mounting head. More particularly, the present invention relates to an improved mounting head for heater treaters, tanks, production and pressure vessels.

2. General Background of the Invention

Sacrificial anodes are used for protection against corrosion of production vessels, such as heater treaters, tanks, pressure vessels, and other production vessels. Anodes for these applications should be simple to replace when consumed.

In typical embodiments, 3-inch diameter×30-inch length and 3-inch diameter×60-inch length cylindrically shaped anodes are mounted in a holder or head such as a commercially available Adair "Red-Head" or "Blue-Head" anode mounting head. These types of anodes. can be easily installed in a standard schedule 40 or schedule 80 pipe nipple (e.g., four-inch (4")) with a coupling such as a Victaulic® coupling.

In prior art applications, aluminum anodes contain nominal amounts of indium, zinc, and silicon that deliver −1.10 volts (with respect to Ag/AgCL reference cell). These anodes deliver protection in produced brines with elevated temperatures. Nominal anode capacity in ambient seawater is 1150 ampere hours per pound. Zinc and Magnesium Anodes in various configurations are also available. Typical applications include internal protection of saltwater storage tanks, heater treaters, ChemElectric units, skimmers, heat exchangers, oil separation vessels, and storage tanks. There can also be custom anodes, mounting assemblies can be fabricated to fit any installation requirement. Elimination of a red head or blue head or other permanent mounting head would simplify the product and potentially reduce the cost.

In the prior art, a fiberglass cap is bolted to the end of a cast anode. The space between the anode and the cap is filled with epoxy. The anode is then inserted into an anode tube in the tank and a two-piece sleeve with a rubber gasket is used to attach the anode to the tank (or other vessel to be protected from corrosion). A wire can be run from a bolt to a portion of the tank to provide good electrical contact between the anode and the tank.

The following possibly relevant U.S. Patents and Publications are incorporated herein by reference:

U.S. Pat. Nos. 629,092; 2,805,987; 3,046,213; 3,058,086; 3,138,549; 3,616,421; and 3,956,819; and, U.S. Patent Application Publication Nos. 2002/055761, and 2007/0029191.

BRIEF SUMMARY OF THE INVENTION

The present invention is a steel encapsulated anode head for heater treaters, tanks, production and pressure vessels. In one embodiment, the apparatus of the present invention is a steel insert with fiberglass, or other suitable material, overmolded. Preferably, the apparatus has a handle to aid in installation and protection of the electrical connection.

The reusable anode head would preferably also be connected to the tank via a coupling. The coupling is preferably a Victaulic® coupling or a generic equivalent thereof.

The reusable anode head of the present invention is able to be reused on multiple anodes. To aid in this installation, the anode head preferably includes a handle. This handle aids in protection of the electrical connection and to protect the contact bolt for connection and monitoring of the anode.

This improved anode and cover protects against leaks because it is preferably a solid molded device. Additionally, it does not use epoxy for connecting the head to the anode as in the prior art, which makes it more efficient to manufacture.

The reusable head cover of the present invention can optionally include centralizer ribs for a sturdier attachment of the anode to the vessel. The apparatus of the present invention may also include a steel rod or insert that contacts the contact bolt and allows for monitoring of anode performance and connection to vessel pressure (important for heater treater anodes). The steel insert also offers further support to the anode along with the ribs, centralizers, or extensions.

The reusable head cover may not have ribs, or the ribs may be removeable from the cover in order to allow the cover of the present invention to be used on anodes that have cast-on ribs as seen in co-owned U.S. patent application Ser. No. 15/448,139 (incorporated herein by reference, but this is not a continuation or continuation-in-part of that patent application). The reusable head cover, handle, and extensions can be made of fiberglass or suitable plastic or other non-electrically conductive material in order to provide electrical isolation of the anode.

BRIEF DESCRIPTION OF THE SEVERAL VIEWS OF THE DRAWINGS

For a further understanding of the nature, objects, and advantages of the present invention, reference should be had to the following detailed description, read in conjunction with the following drawings, wherein like reference numerals denote like elements and wherein:

FIG. 4 is a partial side view of one embodiment of the apparatus of the present invention;

FIG. 5 is a fragmentary side view of a preferred embodiment of the apparatus of the present invention;

FIG. 6 is a partial side view of one embodiment of the apparatus of the present invention;

FIG. 7 is a partial side view of one embodiment of the apparatus of the present invention;

DETAILED DESCRIPTION OF THE INVENTION

Figure 1:
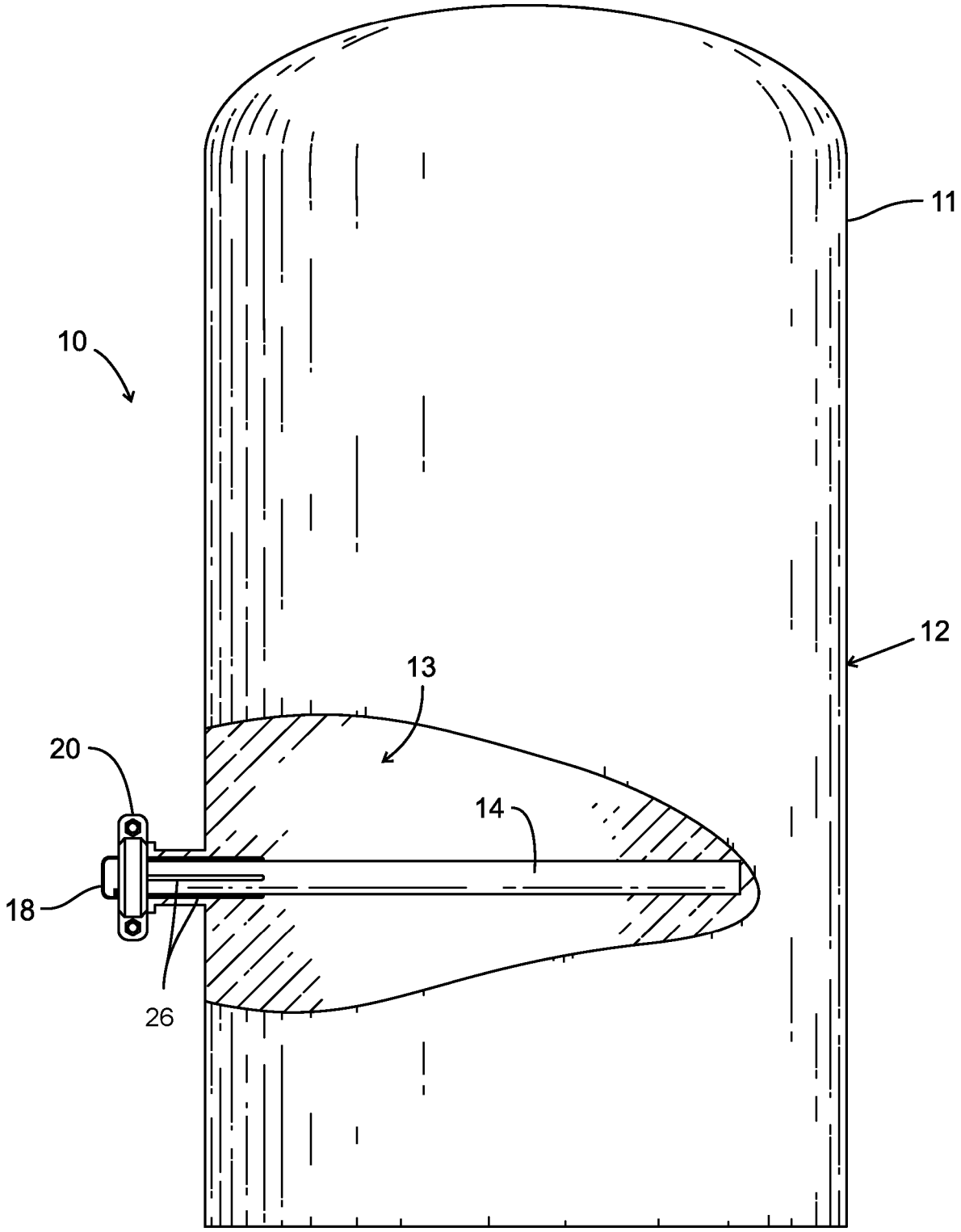
FIG. 1 is an elevation view of a preferred embodiment of the apparatus of the present invention.
Figure 2:
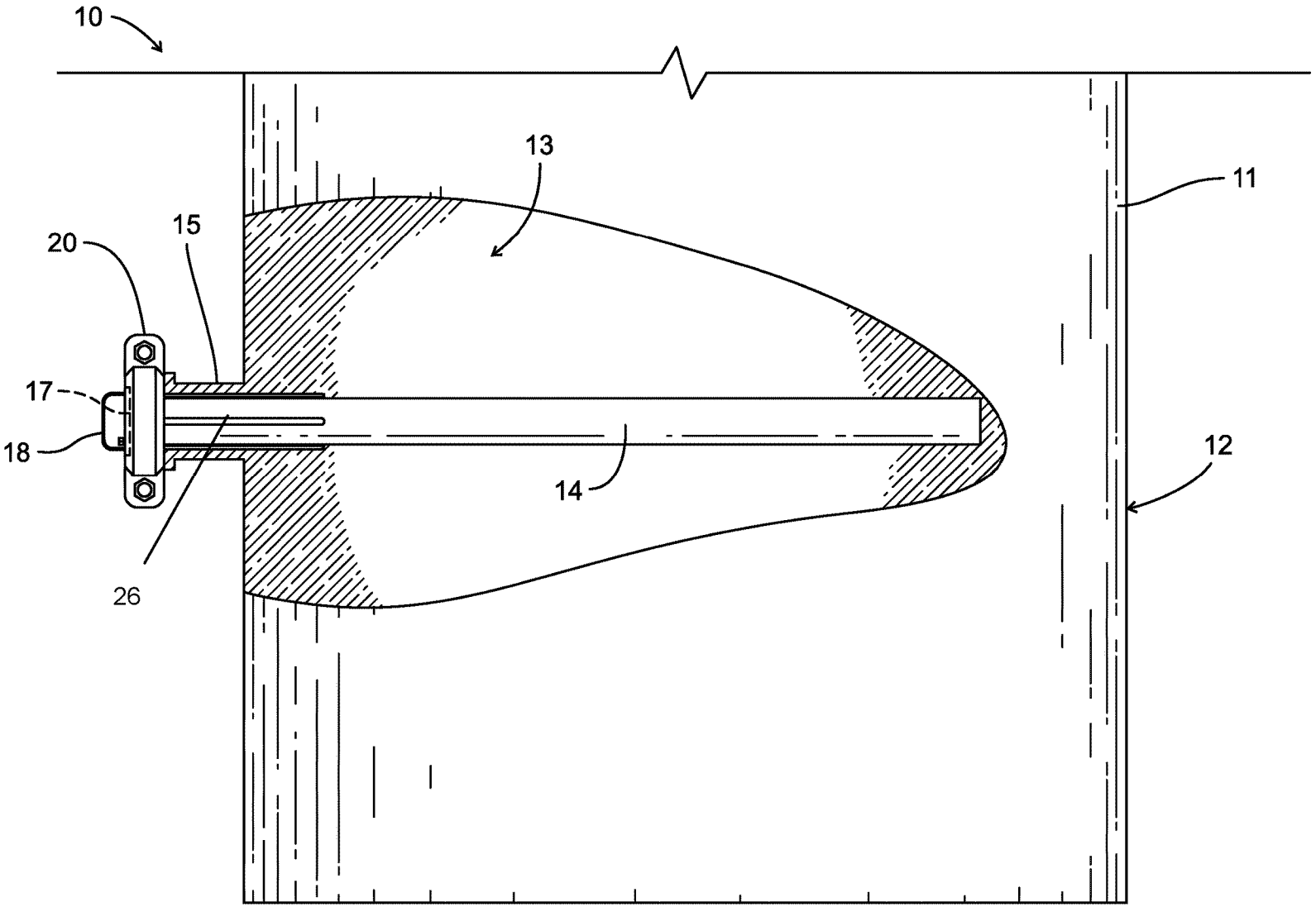
FIG. 2 is a partial elevation view of a preferred embodiment of the apparatus of the present invention.
Figure 3:
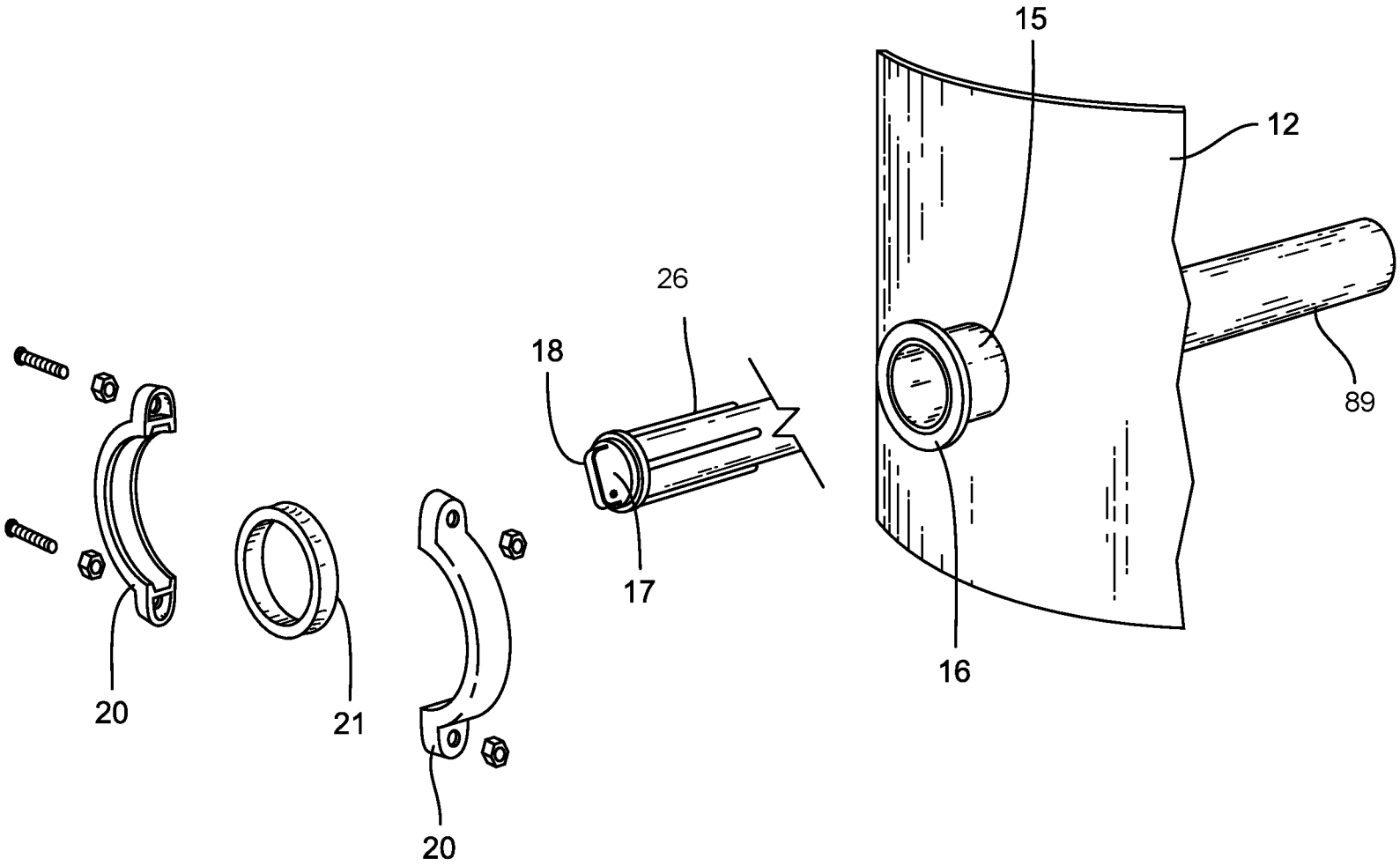
FIG. 3 is an exploded view of a preferred embodiment of the apparatus of the present invention.
Figure 8:
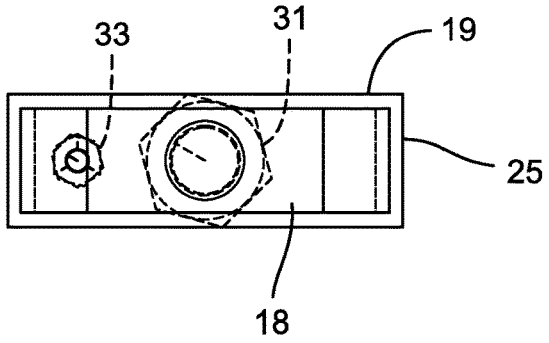
FIG. 8 is a fragmentary top view of a preferred embodiment of the apparatus of the present invention.
Figure 9:
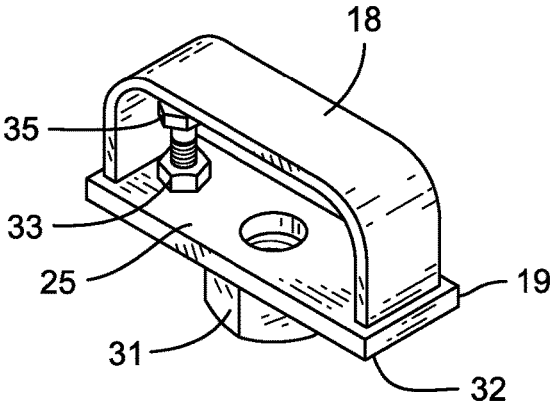
FIG. 9 is a fragmentary perspective view of a preferred embodiment of the apparatus of the present invention.
Figure 10:
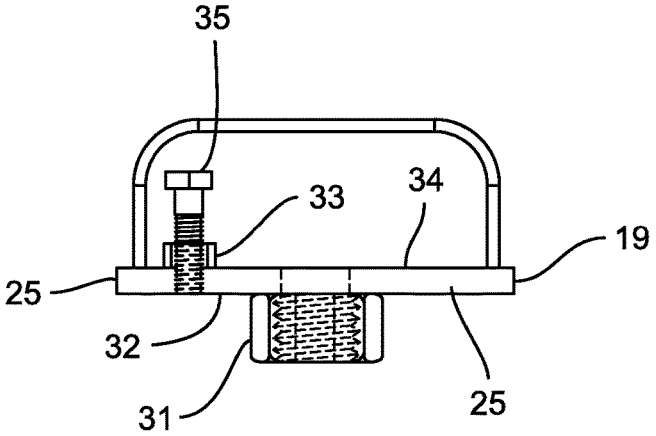
FIG. 10 is a fragmentary side view of a preferred embodiment of the apparatus of the present invention.
Figure 11:
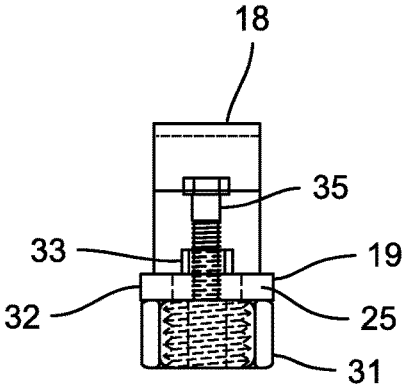
FIG. 11 is a fragmentary end view of a preferred embodiment of the apparatus of the present invention.
Figure 12:
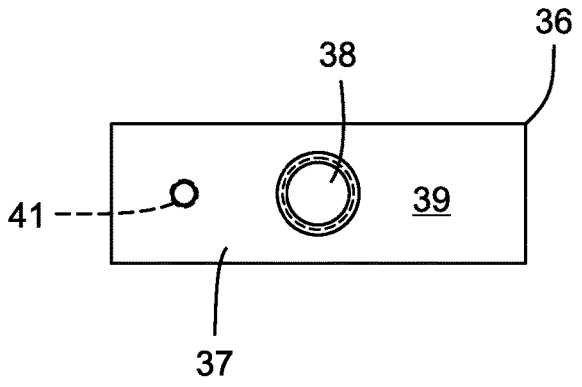
FIG. 12 is a fragmentary top view of a preferred embodiment of the apparatus of the present invention.
Figure 13:
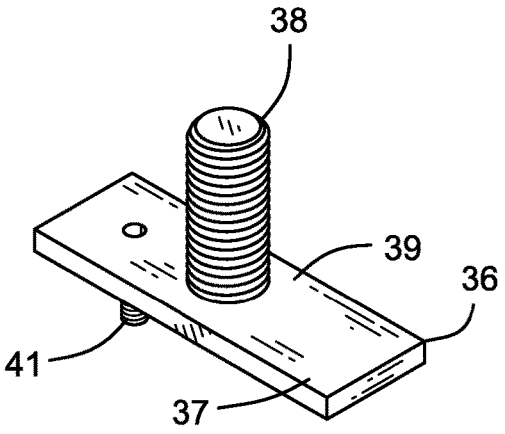
FIG. 13 is a fragmentary perspective view of a preferred embodiment of the apparatus of the present invention.
Figure 14:
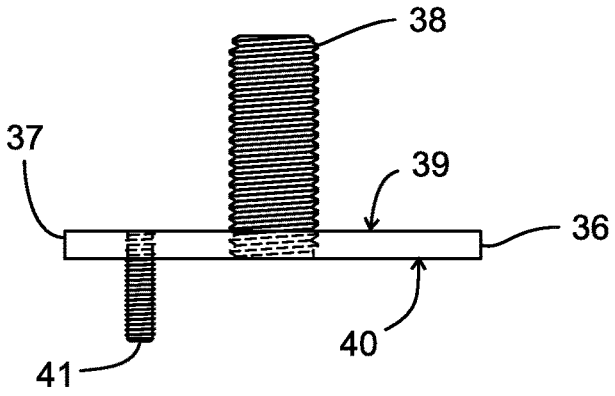
FIG. 14 is a fragmentary side view of a preferred embodiment of the apparatus of the present invention.
Figure 15:
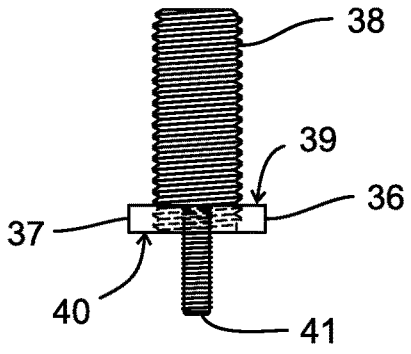
FIG. 15 is a fragmentary end view of a preferred embodiment of the apparatus of the present invention.
Figure 16:
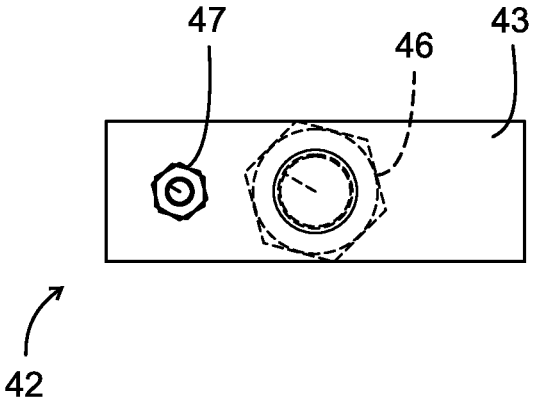
FIG. 16 is a fragmentary top view of a preferred embodiment of the apparatus of the present invention.
Figure 17:
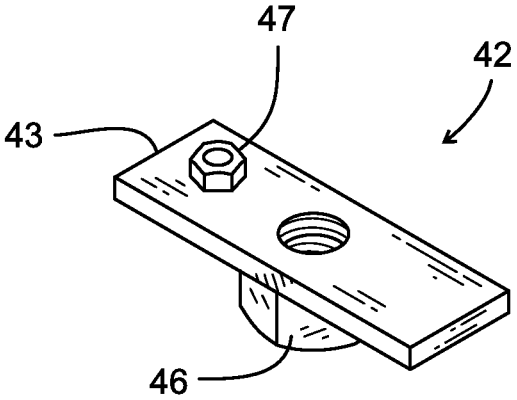
FIG. 17 is a fragmentary perspective view of a preferred embodiment of the apparatus of the present invention.
Figure 18:
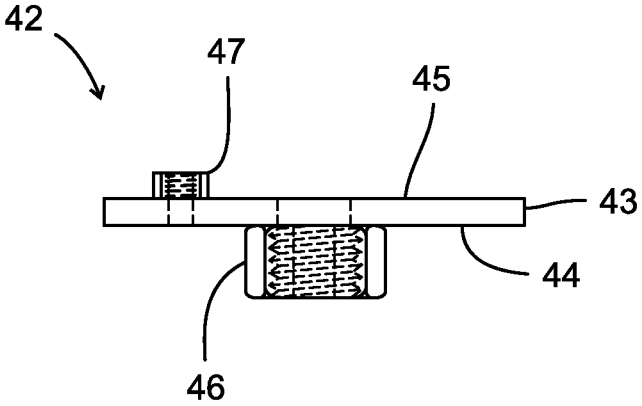
FIG. 18 is a fragmentary side view of a preferred embodiment of the apparatus of the present invention.
Figure 19:
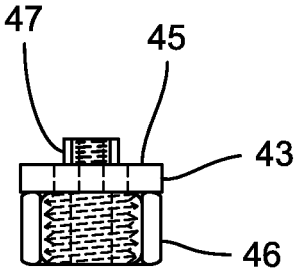
FIG. 19 is a fragmentary end view of a preferred embodiment of the apparatus of the present invention.
Figure 20:
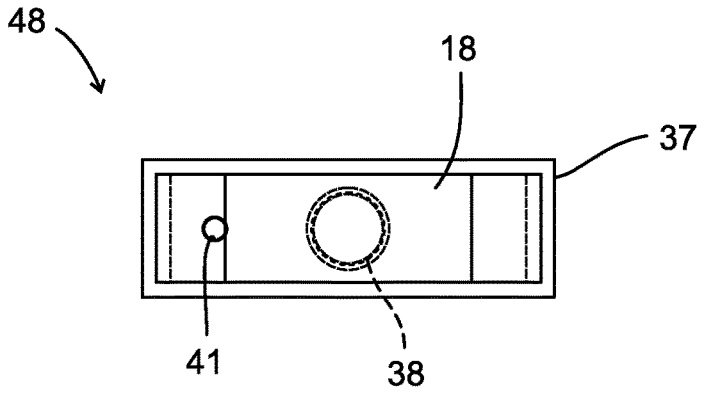
FIG. 20 is a fragmentary top view of a preferred embodiment of the apparatus of the present invention.
Figure 21:
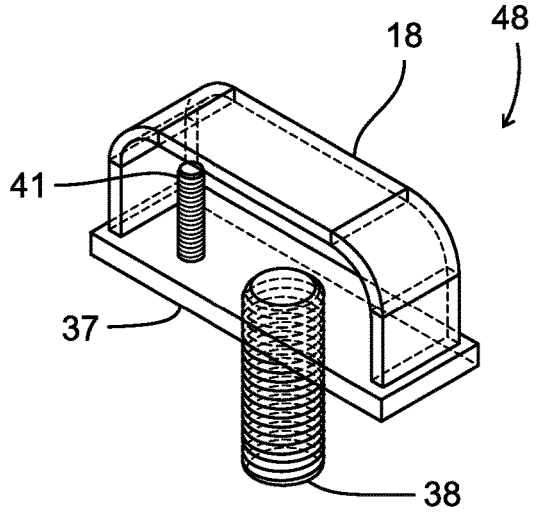
FIG. 21 is a fragmentary perspective view of a preferred embodiment of the apparatus of the present invention.
Figure 22:
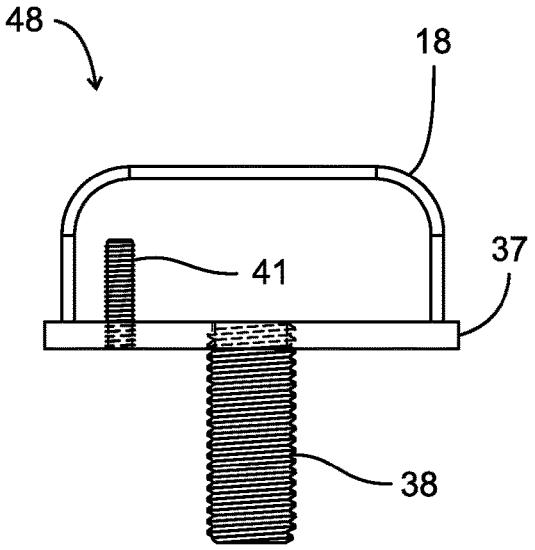
FIG. 22 is a fragmentary side view of a preferred embodiment of the apparatus of the present invention.
Figure 23:
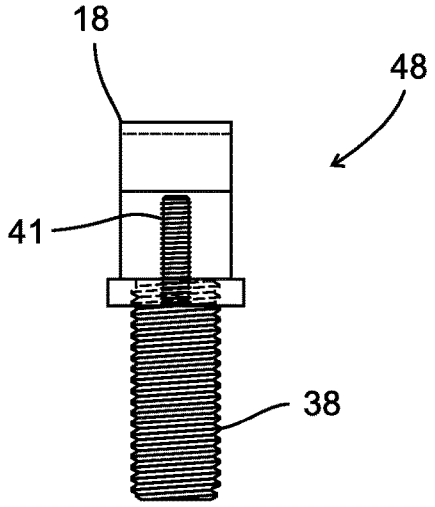
FIG. 23 is a fragmentary end view of a preferred embodiment of the apparatus of the present invention.
Figure 24:
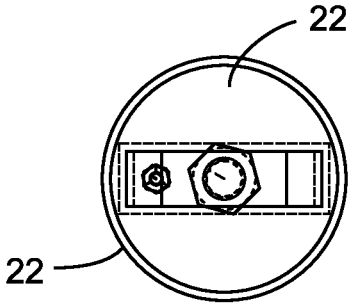
FIG. 24 is a fragmentary top view of a preferred embodiment of the apparatus of the present invention.
Figure 25:
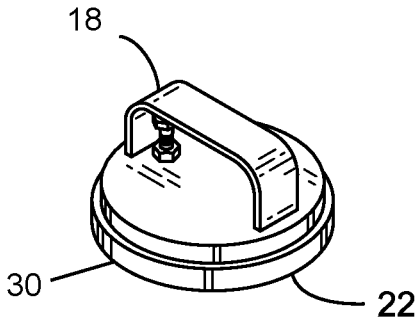
FIG. 25 is a fragmentary perspective view of a preferred embodiment of the apparatus of the present invention.
Figure 26:
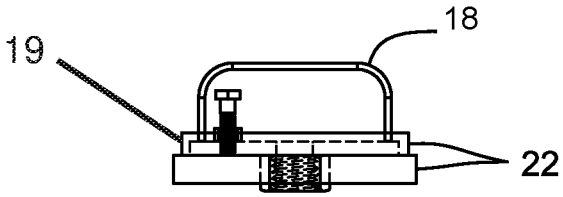
FIG. 26 is a fragmentary side view of a preferred embodiment of the apparatus of the present invention.
Figure 27:
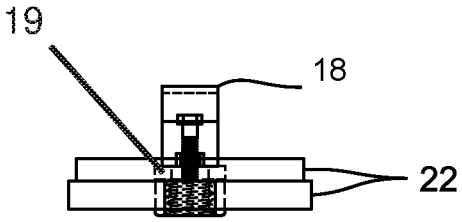
FIG. 27 is a fragmentary end view of a preferred embodiment of the apparatus of the present invention.
Figure 28:
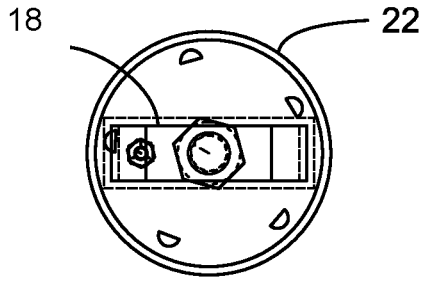
FIG. 28 is a fragmentary top view of a preferred embodiment of the apparatus of the present invention.
Figure 29:
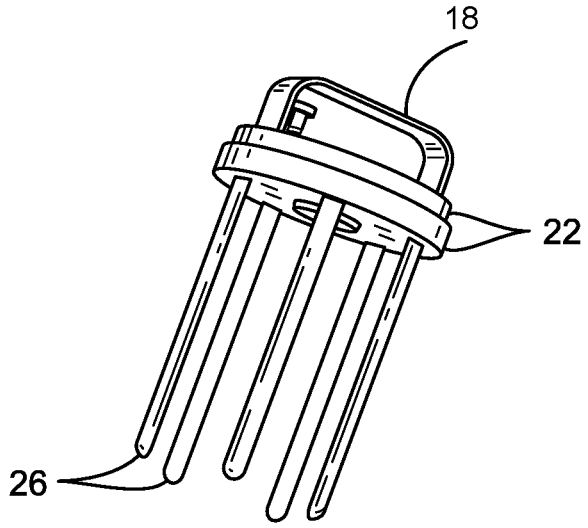
FIG. 29 is a fragmentary perspective view of a preferred embodiment of the apparatus of the present invention.
Figure 30:
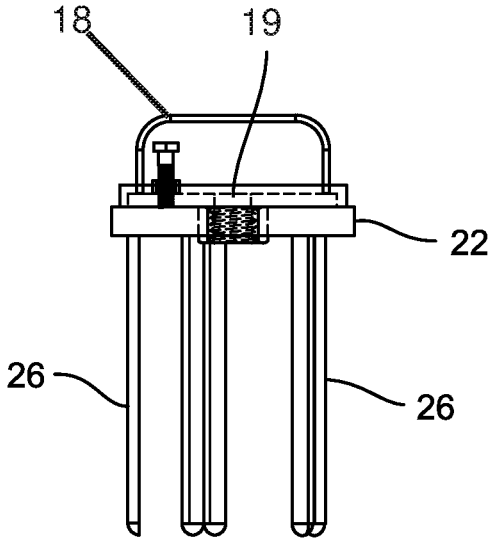
FIG. 30 is a fragmentary side view of a preferred embodiment of the apparatus of the present invention.
Figure 31:
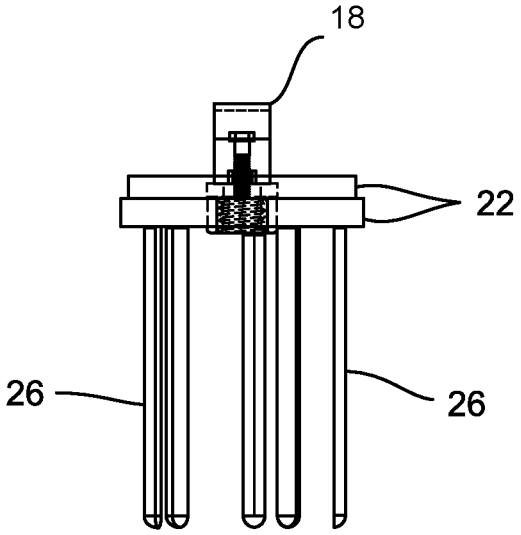
FIG. 31 is a fragmentary end view of a preferred embodiment of the apparatus of the present invention.
Figure 32:
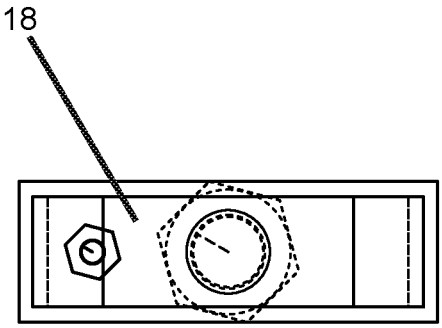
FIG. 32 is a fragmentary top view of a preferred embodiment of the apparatus of the present invention.
Figure 33:
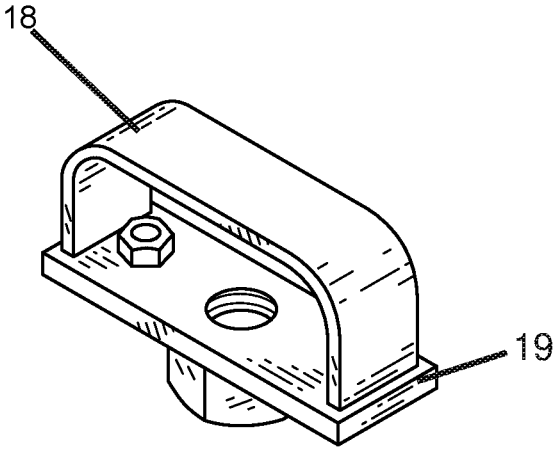
FIG. 33 is a fragmentary perspective view of a preferred embodiment of the apparatus of the present invention.
Figure 34:
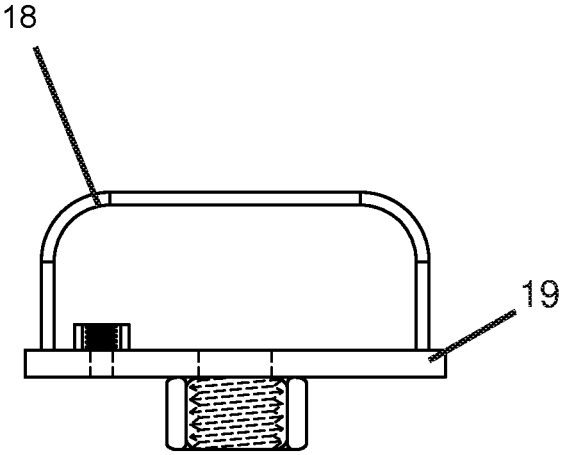
FIG. 34 is a fragmentary side view of a preferred embodiment of the apparatus of the present invention.
Figure 35:
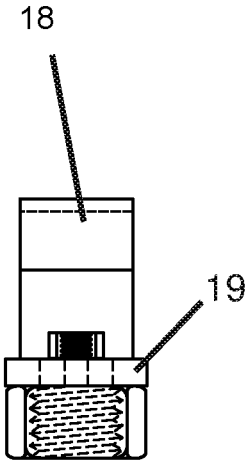
FIG. 35 is a fragmentary end view of a preferred embodiment of the apparatus of the present invention.

FIGS. 1-3 show the preferred embodiment of the apparatus of the present invention designated generally by the numeral 10. Anode mounting system 10 can be used to protect a vessel 11 from corrosion. Vessel 11 has an outer surface or outer wall 12 surrounding a vessel interior 13. Anode 14 can be removably connected to reusable cap or body or head 17. Cap or body or head 17 can provide handle 18 for carrying the apparatus 10 and insert 19 to which anode 14 attaches. The reusable cap, body or head thus has a non-metallic portion and a metallic insert portion 19. The insert 19 can be of different configurations as seen in FIGS. 8-23, 32-35 and 44-54. A Victaulic® or like coupling 20 having gasket 21 can be used to join reusable cap 17 to flange 16 on pipe 15 that is welded to vessel 11.

A shown in FIG. 4, cap, body or head 17 has outer side 23 and inner side 24. Inner side 24 is preferably provided with a threaded rod or stud or nut for connecting to an anode 14. Outer side 23 preferably has threaded rod, stud or nut for enabling an electrical connection to be perfected between metallic insert 19 and the vessel 11 wall 12 via a known electrical cable (not shown). Reusable anode head or cover 17 is preferably removably attached to the anode 14. In some embodiments, as shown in FIG. 4, cap, body, or head 17 further includes threads 88 for attaching to a vessel 11 that has a threaded opening instead of a pipe flange 15. In this type of embodiment, a coupling or clamp 20 is not needed.

Preferably, the anode 14 has a length, a first end that extends beyond the interior of the vessel 11, a second end that is encased within the vessel 11, and a body between the first and second ends (see FIGS. 1 and 2). The anode 14 is preferably cylindrical in shape and typically has a 3-inch diameter; however, other shapes and/or diameters and sizes can be used with the present invention. The anode length is typically 30 to 60 inches in length; however any length can be used with the present invention.

Figure 43:
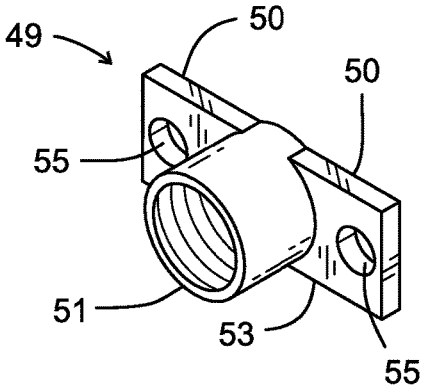
FIG. 43 is a fragmentary perspective view of an alternate metallic insert.
Figure 44:
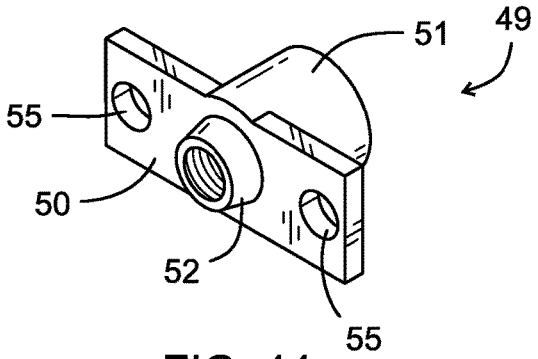
FIG. 44 is a fragmentary perspective view of an alternate metallic insert.

The anode head/cover 17 preferably has anode cover extensions or centralizers 26 that extend along the anode 14 into the vessel (see FIGS. 2, 6-7, 28-31, 40). In this embodiment, the extensions or centralizers may be straight or geometrically appropriate/modified to accommodate an anode or components of smaller diameters. In FIG. 43, centralizers 27 can be spaced from cap 17 and held to the anode 14 with straps 28. Preferably, the straps 28 are flexible.

The present invention 10 improves on the prior art because upon corrosion of the anode, the anode cover 17 and centralizers 26 or 27 can be removed and reused on a new anode 14.

In preferred embodiments, the anode head cover 17 includes a handle 18 attached to the anode cover opposite from the anode cover extensions 26, as shown. In some embodiments, the handle 18 can be metallic and part of a metallic insert 19 (e.g., see FIGS. 8-11). In other embodiments, the handle is non-metallic (e.g., plastic) and is cast with the generally cylindrically shaped part 30 of non-metallic portion 22 of cap 17 wherein the metallic portion has no handle as seen for example in FIGS. 12-19. The cylindrically shaped portion can include a longer diameter cylindrical part that is an annular flange for connecting to annular pipe flange 16 using coupling 20.

The measurements can be altered to appropriate sizes standard anodes, includes a 3×30 anode, or 3×60 anode. However, the present invention can be adjusted to various anodes and vessels as needed, even those that are not standard sizes, because the straps 28 allow the centralizers 27 to be adjusted as needed to accommodate different sizes and shapes.

In preferred embodiments, the reusable anode head 17 can attach directly to the vessel 11 to be protected (e.g., to flanged pipe 15 having flange 16 that is welded to the vessel 11 as seen in FIGS. 1-3). Alternatively, an end of the reusable anode cap 17 can be used to connect a shunt, resistor, current regulator, or monitoring system.

In preferred embodiments, the anode head cap 17 can attach to an anode 14 at the side where the centralizers 26 are located, such that the centralizers 26 extend some length along the anode 26. Preferably, centralizers 26, 27 are 5-6 inches in length or longer; however, any suitable length can be used. Alternatively, the head 17 can be attached to a reference cell, reference electrode, pH electrode, corrosion test coupon, monitoring or control system, or a "mounting system" other than a sacrificial anode, 89 to hold other components at this same location.

Figure 39:
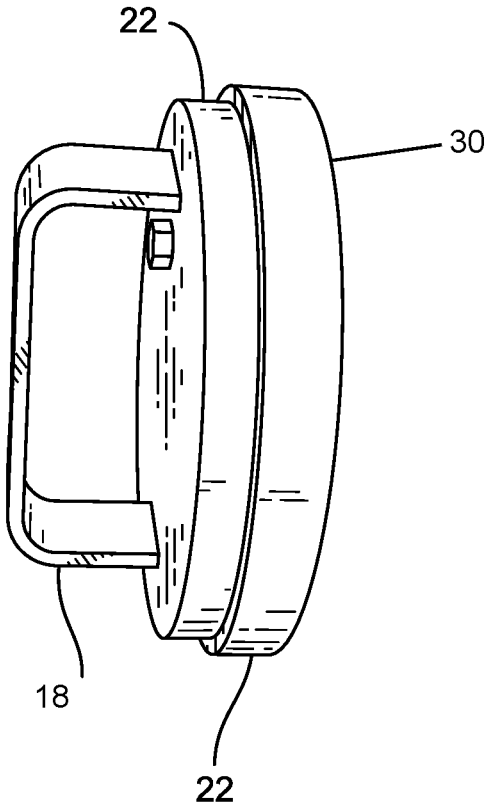
FIG. 39 is a partial perspective view of a preferred embodiment of the apparatus of the present invention.
Figure 40:
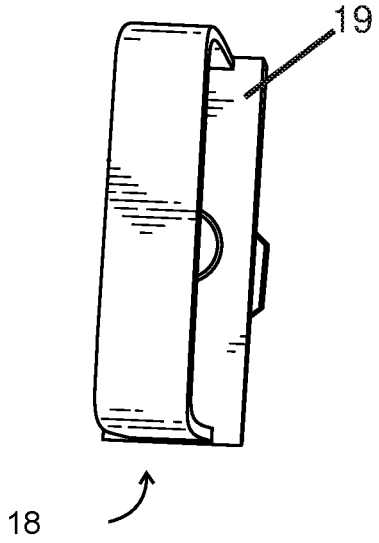
FIG. 40 is a fragmentary perspective view of a preferred embodiment of the apparatus of the present invention.
Figure 41:
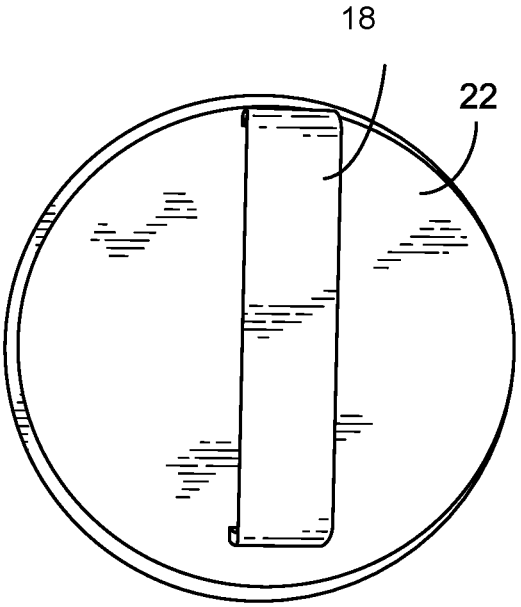
FIG. 41 is s a fragmentary top view of a preferred embodiment of the apparatus of the present invention.

A non-metallic portion 22 of reusable anode cap 17 can be made of fiberglass or plastic with proper die electrics, thermal, and physical properties. Some appropriate materials may include fiberglass, Kynar®, Valox™, or other similar suitable materials. Materials for non-metallic portion 22 can include thermoset polyester reinforced plastics, or non-thermoset plastics that are reinforced with fiberglass. The material could meet or exceed the characteristics found in Haysite™ Fiber Reinforced Polyester. The handle 18 can be molded of the same fiberglass or plastic material of the head cover 17 (e.g., see FIGS. 39-40 and or it may be made of steel or metallic material and be part of an insert or core 19 as seen in FIGS. 9-11, 20-35. The handle 18 when connected to the core of the anode 14 or other device allows for electrical connection point between the anode 14 or other device.

In some embodiments, the anode 14 is cylindrical having a hollow center. In these embodiments, the anode head cover 17 preferably includes a steel rod or insert that fits in the anode 14 hollow center (e.g., see FIGS. 12-15 and 20-23).

Non-metallic portion 22 can be produced via injection molding, compression moulding, or other suitable methods. During such moulding, any selected insert or core of FIG. 8-23, 32-35 or 43-53 is preferably imbedded in the non-metallic portion 22 (e.g., see FIGS. 28-43-53, and 56-57).

FIGS. 5 and 8-11 show a first metallic insert or core 19. Insert or core 19 is preferably made of mild steel construction; however, any suitable conductive material could be used. Preferably, insert or core 19 has plate 25 to which is welded nut 31 on side 32 of plate 25. Nut 33 is preferably mounted (e.g., welded) to side 34 of plate 25. Handle 18 is preferably connected (e.g., welded) to sider 34 of plate 25. A bolt 35 is preferably removably attached to nut 33 as seen in FIGS. 8-11 and 32-35 (bolt 35 removed). Bolt 35 enables an electrical connection between insert or core 19 and wall 12 of vessel 11.

Internally threaded nut 31 enables connection to an externally threaded rod or stud that is part of an as-manufactured anode 14.

In FIGS. 12-15, there is no handle 18. The insert of FIGS. 12-15 uses threaded studs instead of nuts used in the insert 19 of FIGS. 8-11.

In FIGS. 12-15, insert or core 36 has a plate 37 with opposed sides 39, 40. Threaded stud 38 is preferably mounted (e.g., welded) to side 39. Threaded stud 41 is preferably mounted (e.g., welded) to side 40. Insert or core 36 can be of welded steel construction; however, any conductive material can be used. Stud 38 is preferably configured to connect with an internally threaded bore of an as-built anode 14. Stud 41 enables an electrical connection to be perfected between stud 41 and tank 11 wall 12 using a known cable.

In FIGS. 16-19, insert 42 has plate 43 with opposed sides 44, 45. Nut 46 preferably attaches (e.g., welded) to side 44 of plate 43. Nut 47 preferably attaches (e.g., welded) to side 45 of plate 43. If using insert or core 42, the non-metallic portion could include handle 18 which could be part of the molded (e.g., plastic) part that encapsulates insert 42.

Insert 48 is seen in FIGS. 20-23. Insert 48 is similar to insert 36 of FIGS. 12-15 but adds a metallic handle 18.

FIGS. 24-27 show insert 19 embedded in non-metallic portion 22 (e.g., fiberglass or plastic with proper die electrics, thermal, and physical properties; Kynar®, Valox™ thermoset polyester reinforced plastics, or non-thermoset plastics that are reinforced with fiberglass, other material that meets or exceeds the characteristics found in Haysite™ Fiber Reinforced Polyester; or other suitable material). FIGS. 28-31 are similar to FIGS. 24-27 and 37 but with cap 17 having multiple centralizers 26, each being moulded with non-metallic portion 22. In FIGS. 28-31 and 37 there are five (5) centralizers 26 but there could be more or less. In preferred embodiments, there are preferably between 3 and 6 centralizers 26, 27; more preferably between 4 and 5 centralizers 26, 27.

FIGS. 32-35 show the insert 19 of FIGS. 8-11 but with bolt 35 removed.

Figure 36:
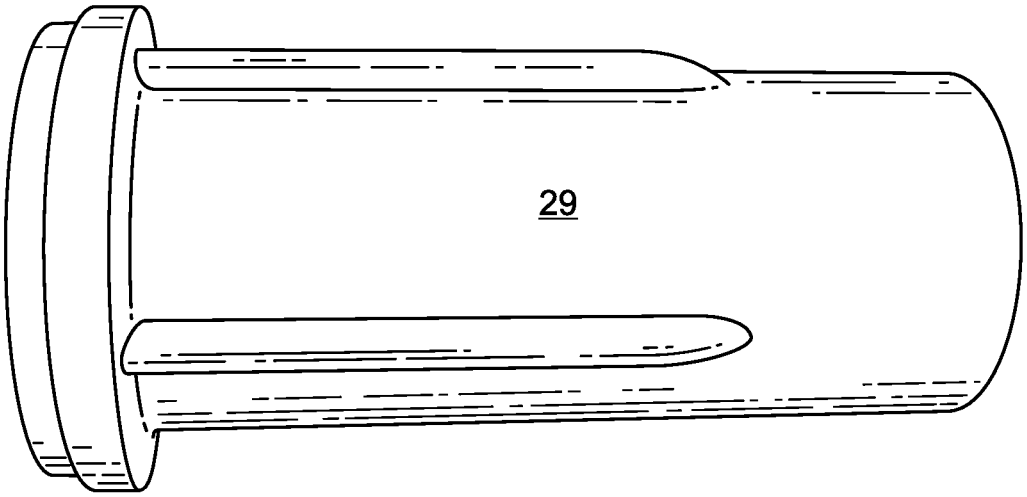
FIG. 36 PRIOR ART
FIG. 36 is a perspective view of a prior art anode and cap arrangement.
Figure 37:
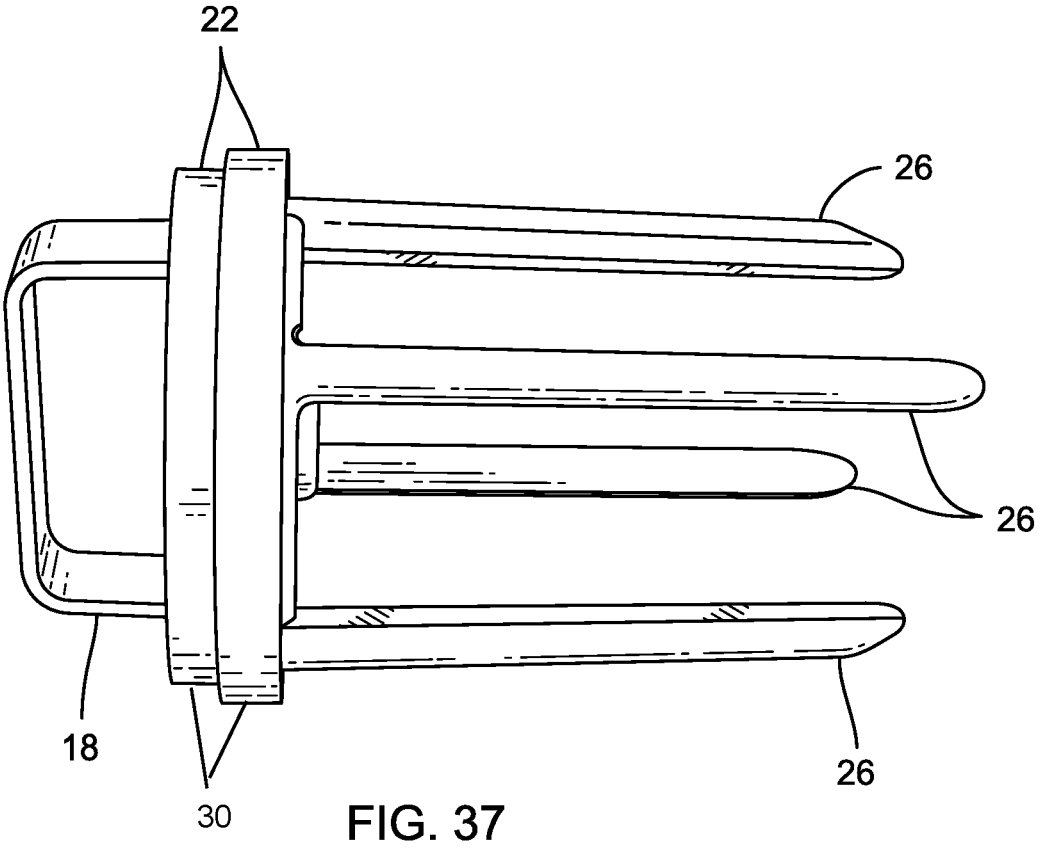
FIG. 37 is a perspective view of an alternate embodiment of the apparatus of the present invention.
Figure 38:
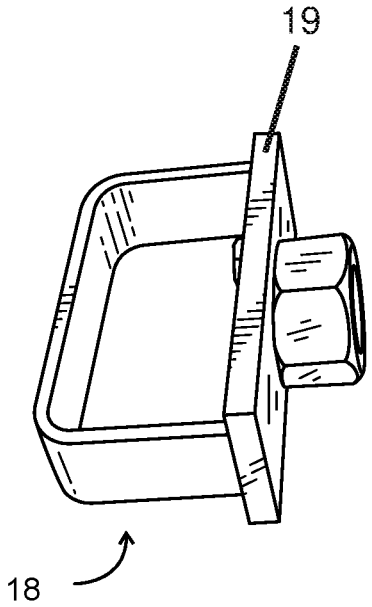
FIG. 38 is a partial perspective view of a preferred embodiment of the apparatus of the present invention.

FIG. 36 shows a prior art anode 29 such as Adair "Red Head" or "Blue Head".

FIGS. 38-41 show non-metallic portion 22 after moulding to encapsulate or imbed core or insert 19 of FIGS. 8-11.

Figure 42:
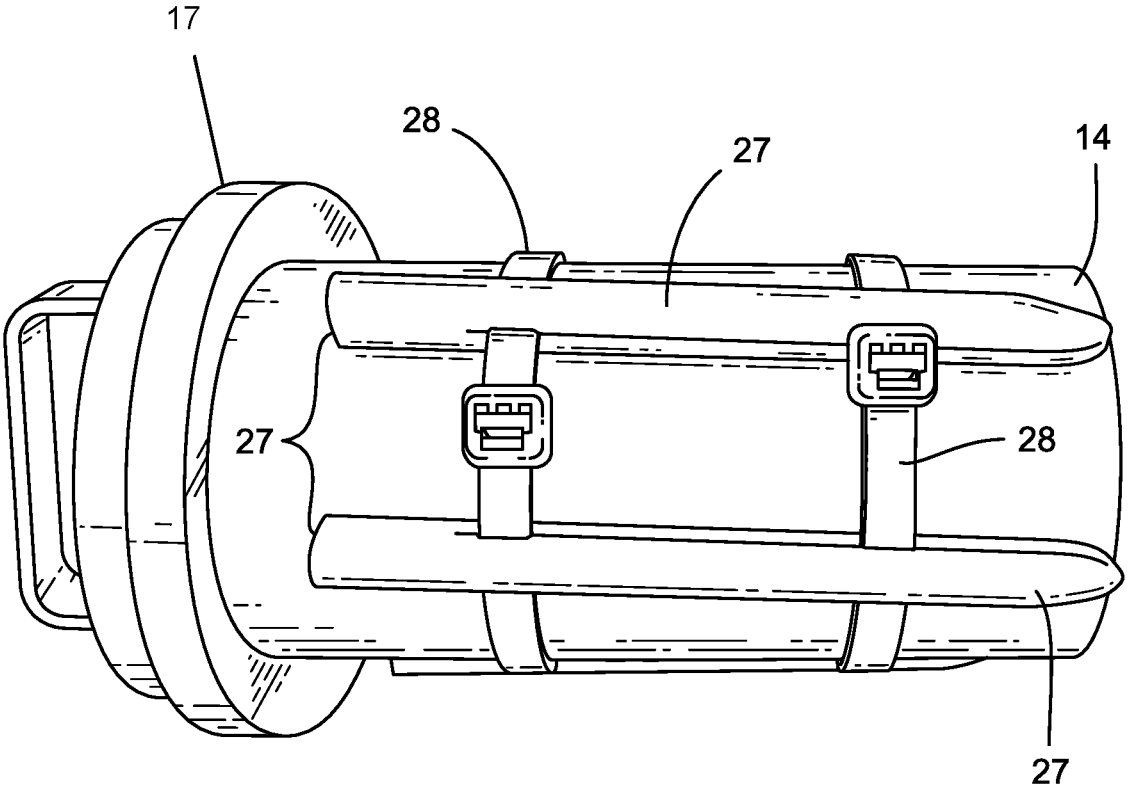
FIG. 42 is a side view of an alternate embodiment of the apparatus of the present invention.
Figure 55:
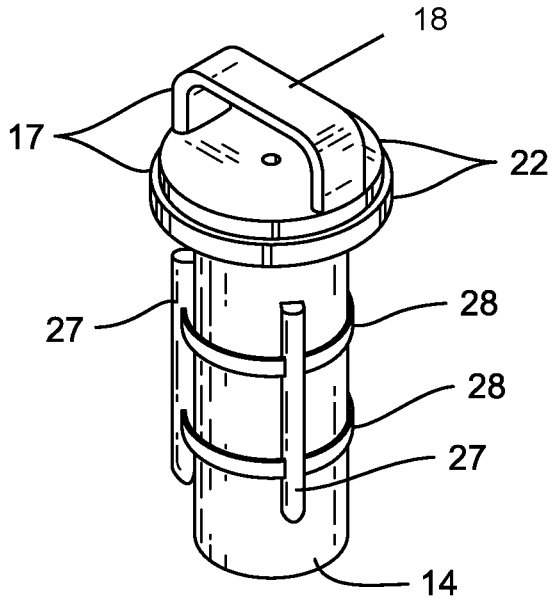
FIG. 55 is a partial perspective view of an alternate embodiment of the apparatus of the present invention.

FIGS. 42 and 55 show optional centralizers 27 attached to an anode 14 using straps 28. In FIG. 42, centralizers 27 are spaced away from reusable cap or head 17.

FIGS. 43-53 show other configurations for inserts or cores that would preferably be a metallic part of reusable cap or head 17.

In FIG. 43 (bottom perspective view) and 44 (top perspective view) there can be seen insert or core 49. Insert or core 49 has plate 50 with opposed sides 53, 54. Larger diameter internally threaded sleeve 52 extends from side 53 of plate 50. Sleeve 52 could be used to perfect a threaded connection with an externally threaded rod or stud that is a part of an as-built anode 14. Sleeve 52 could be used to connect with a threaded bolt such as bolt 35 of FIGS. 8-11. Openings 55 would fill with plastic or other moulded material that encapsulates insert 49 to help anchor the insert 49 within the non-metallic moulded portion 22 of reusable cap 17.

Figure 45:
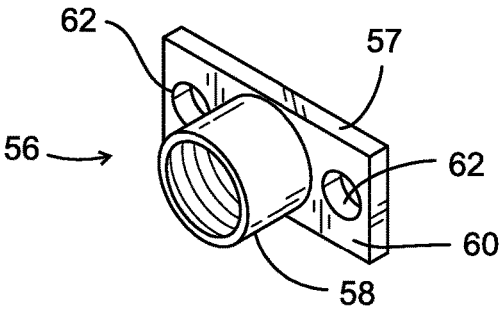
FIG. 45 is a fragmentary perspective view of an alternate metallic insert.
Figure 46:
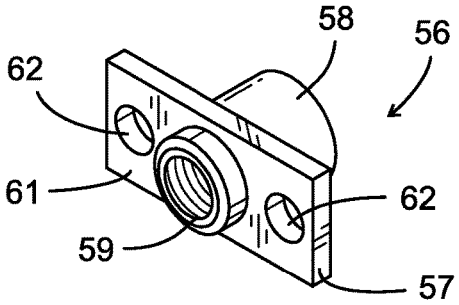
FIG. 46 is a fragmentary perspective view of an alternate metallic insert.

FIGS. 45 and 46 are bottom and top views respectively of insert or core 56. As with insert 49, insert or core 56 includes plate 57 with sides 60, 61, sleeve 58, sleeve 59 and openings 62.

Figure 47:
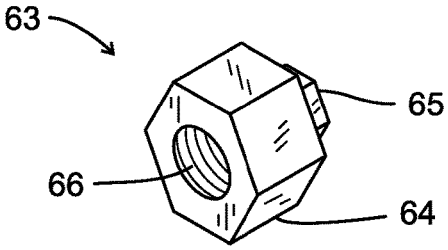
FIG. 47 is a fragmentary perspective view of an alternate metallic insert.
Figure 48:
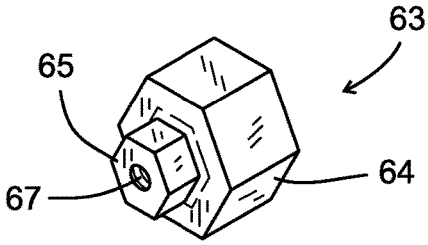
FIG. 48 is a fragmentary perspective view of an alternate metallic insert.

In FIGS. 47 and 48, insert 63 includes larger 64 and smaller 65 hexagonally shaped, internally threaded portions. The larger hexagonally shaped portion 64 has larger diameter internally threaded bore 66. The smaller hexagonally shaped portion 65 has smaller diameter internally threaded bore 67. Bore 66 would connect with a threaded stud that was part of an as built anode 14. Bore 67 would connect with a threaded bolt such as bolt 35 of FIGS. 8-11. Insert or core 63 would be encapsulated into or embedded in non-metallic (e.g., plastic) portion 22 of reusable cap or head 17. Insert 63 can be welded steel construction.

Figure 49:
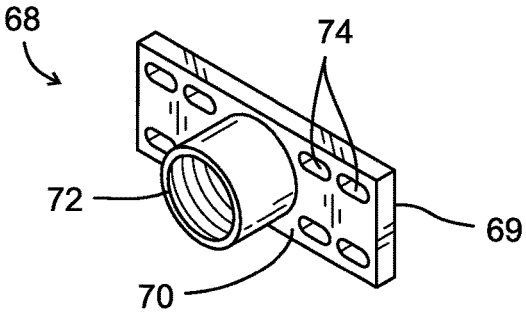
FIG. 49 is a fragmentary perspective view of an alternate metallic insert.
Figure 50:
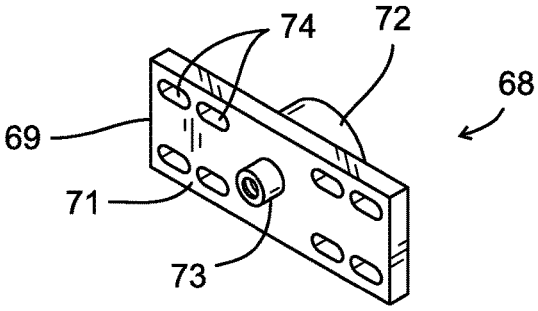
FIG. 50 is a fragmentary perspective view of an alternate metallic insert.

FIGS. 49-50 show another insert or core 68. Insert 68 has plate 69 with opposed sides 70, 71. Internally threaded sleeve 72 (larger diameter) extends from side 70 of plate 69. Internally threaded sleeve 73 (smaller diameter) extends from side 71 of plate 69. Sleeve 72 would connect with a threaded stud that was part of an as built anode 14. Sleeve 73 would connect with a threaded bolt such as bolt 35 of FIGS. 8-11. Oval shaped openings or slots 74 would fill with plastic during moulding of the non-metallic portion 22 of reusable cap 17 thus assisting in the bond between insert or core 58 and the moulded, non-metallic (e.g., plastic) portion 22.

Figure 51:
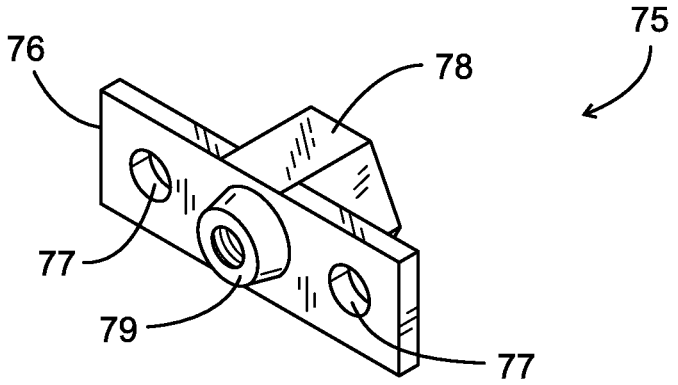
FIG. 51 is a fragmentary perspective view of an alternate metallic insert.
Figure 52:
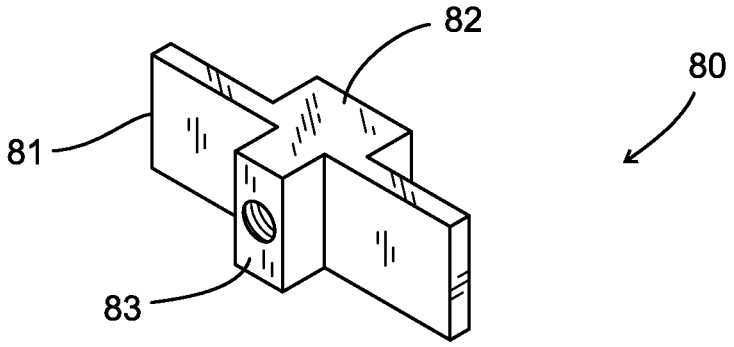
FIG. 52 is a fragmentary perspective view of an alternate metallic insert.
Figure 53:
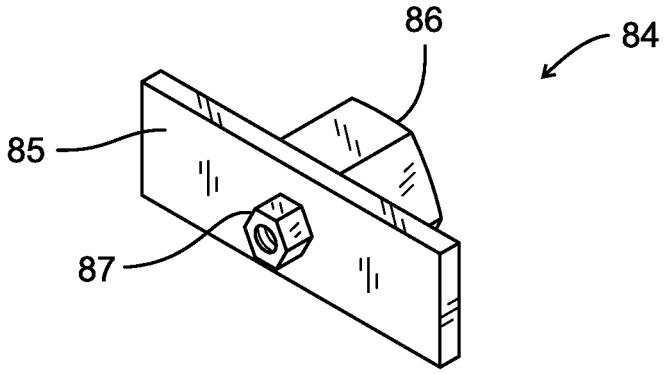
FIG. 53 is a fragmentary perspective view of an alternate metallic insert.
Figure 54:
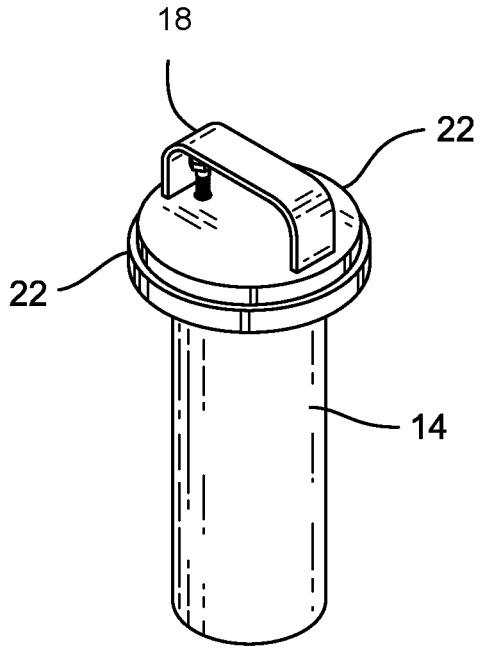
FIG. 54 is a partial perspective view of a preferred embodiment of the apparatus of the present invention.

FIGS. 51-53 show other insert or core configurations. In FIG. 51, insert 75 has plate 76, openings 77, larger hexagonally internally threaded portion 78 (for connecting to a stud of an as built anode 14) and smaller internally threaded sleeve 79 (for connecting to a bolt such as 35 of FIGS. 8-11).

In FIG. 52, insert 80 has plate 81 supporting larger 82 and smaller 83 internally threaded block portions. Larger internally threaded block 82 has a larger diameter internally threaded bore for connecting with an externally threaded stud of an as build anode 14. Smaller internally threaded block portion 83 forms a connection with a bolt such as a bolt 35 of FIGS. 8-11.

In FIG. 53, insert or core 84 has plate 85 with a larger hexagonally shaped portion 86 having an internally threaded bore and a smaller hexagonally shaped portion having an internally threaded bore. The internally threaded bore of portion 86 connects with the threaded stud of an as built anode 14. The internally threaded bore of portion 87 connects with a bolt such as bolt 35 of FIG. 8-11.

All cores or inserts of FIGS. 43-53 can be of metallic (e.g., welded steel, or any conductive material) construction and are embedded or encapsulated by plastic or other non-metallic material 22 during molding.

Anode head 17 of the present invention can be attached to any suitable anode, such as the anodes shown in FIGS. 5-8 of U.S. Pat. No. 10,604,851 issued to Galvotec Alloys, Inc. and incorporated herein by reference, or to monitoring devices.

Non-threaded holes 62 in insert 56 in FIGS. 45, 46, 56 and 57 are optional and help to anchor insert 56 in the plastic cap of the present in invention and reduce the likelihood of rotation of insert 56 during molding, and to reduce the likelihood of a tendency of the insert 56 to rotate when threaded studs or bolts are screwed into holes 58 and 59 after manufacture. Similar holes 55 (insert 49 in FIGS. 43 and 44), 74 (insert 68 in FIGS. 49 and 50), and 77 (insert 75 in FIG. 51) serve the same purpose. These holes are optional but preferred.

Figure 56:
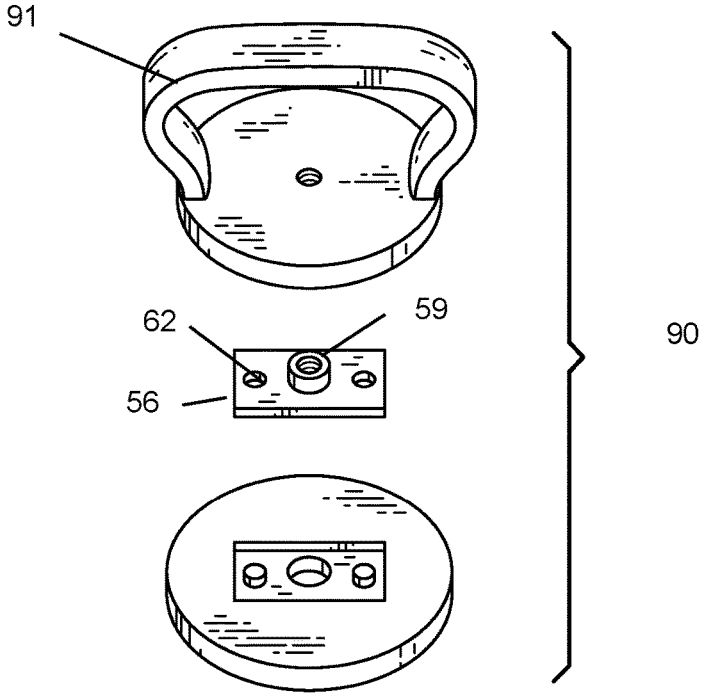
FIG. 56 is a fragmentary exploded view of an alternate embodiment of the apparatus of the present invention.
Figure 57:
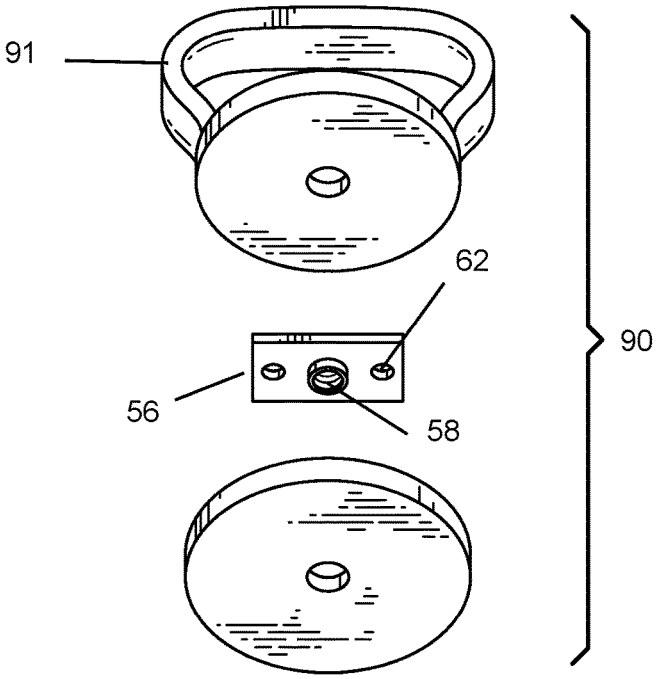
FIG. 57 is a fragmentary exploded view of an alternate embodiment of the apparatus of the present invention.

FIGS. 56 and 57 show exploded views of an embodiment of the present invention as though a cap 22 as shown in FIG. 55 were cut in half and metal insert 56 (see FIGS. 45, 46, 56 and 57) removed. This is for illustrative purposes only. Preferably, metal insert 56 is placed in a mold and the plastic cap is molded over as a unitary unit it to produce an embodiment of cap 90 of the present invention similar to cap 22 shown, for example, in FIG. 55 (though the handle 18 in FIG. 55 is a slightly different shape from handle 91 of FIGS. 56 and 57).

The present invention also includes a method of protecting a vessel from corrosion, wherein the method comprises the following steps:

a) attaching the anode 14 and head cover 17 of the present invention 10 to the vessel 11 to be protected;
b) upon corrosion of the anode 14, removing the head cover 17 from the corroded anode 14;
c) attaching the head cover 17 to a new anode 14;
d) attaching the new anode 14 and head cover 17 to the vessel 11; and
e) repeating steps (b) through (d) as needed.

The following is a list of parts and materials suitable for use in the present invention:

PARTS LIST

Parts Number Description
10 anode mounting system/anode holder apparatus
11 vessel
12 outer surface/outer wall
13 interior
14 anode
15 pipe with mounting flange
16 mounting flange
17 head cover/reusable anode head/body
18 handle
19 insert/core
20 clamp/coupling, preferably Victaulic® coupling
21 gasket
22 non-metallic portion
23 outer side
24 inner side
25 plate
26 extension/centralizer
27 centralizer

28 strap
29 prior art anode head or cap
30 cylindrically shaped portion/annular flange
31 nut
32 side
33 nut
34 side
35 bolt
36 insert/core front side
37 insert/core back side
38 threaded stud
39 side
40 side
41 threaded stud
42 core/insert front side
43 core/insert back side
44 side
45 side
46 nut
47 nut
48 insert
49 insert
50 plate
51 larger diameter internally threaded sleeve
52 smaller diameter internally threaded sleeve
53 side
54 side
55 opening
56 insert/core front side
57 insert/core back side
58 larger diameter internally threaded sleeve
59 smaller diameter internally threaded sleeve
60 side
61 side
62 opening
63 insert
64 larger hexagonally shaped portion
65 smaller hexagonally shaped portion
66 larger diameter internally threaded bore
67 smaller diameter internally threaded bore
68 insert/core front side
69 insert/core back side
70 side
71 side
72 larger diameter internally threaded sleeve
73 smaller diameter internally threaded sleeve
74 slots/oval shaped openings
75 insert/core front side
76 insert/core back side
77 openings
78 hexagonally shaped internally threaded portion
79 internally threaded portion threaded sleeve
80 insert/core front side
81 insert/core back side
82 larger internally threaded block portion
83 smaller internally threaded block portion
84 insert/core front side
85 insert/core back side
86 larger hexagonally shaped internally threaded bore portion
87 smaller hexagonally shaped internally threaded bore portion
88 threads
89 anode, test coupon, or other tank monitoring device
90 cap
91 handle All measurements disclosed herein are at standard temperature and pressure, at sea level on Earth, unless indicated otherwise. All materials used or intended to be used in a human being are biocompatible, unless indicated otherwise.

The foregoing embodiments are presented by way of example only; the scope of the present invention is to be limited only by the following claims.

The invention claimed is:

1. An anode mounting apparatus that is configured to attach to a selected vessel that is to be protected from corrosion, wherein the vessel has a vessel wall and a vessel interior, comprising:

a) a reusable cap that includes a non-metallic portion;
b) an anode body;
c) said cap carrying a metallic component imbedded in said non-metallic portion that has a connecting portion configured to removably connect with said anode;
d) wherein the cap is separable from the anode body in a disconnected position, wherein said metallic component remains imbedded within said cap in said disconnected position;
e) wherein the anode body is removably attachable to the connecting portion of said metallic component;
f) said metallic component having a metal fastener that forms a removable connection between the metallic component and the vessel wall; and
g) said metal fastener enabling electrical connection to:
a shunt for current or voltage monitoring; and
a resistor for regulation of anode current or voltage output.

2. The anode mounting apparatus of claim 1 wherein the cap has a cap width or diameter and further comprising a generally U-shaped handle connected to the cap at first and second spaced apart positions and that extends over a majority of said cap width or diameter.

3. The anode mounting apparatus of claim 2 wherein the handle is part of the metallic component.

4. The anode mounting apparatus of claim 1 further comprising a plurality of centralizers that extend along the anode body.

5. The anode mounting apparatus of claim 4 wherein the centralizers are non-metallic.

6. The anode mounting apparatus of claim 4 wherein the centralizers connect to the cap.

7. The anode mounting apparatus of claim 6 wherein the cap has a cap periphery and the centralizers connect to the cap at said cap periphery.

8. The anode mounting apparatus of claim 1 wherein the connecting portion is a threaded rod, stud or nut.

9. The anode mounting apparatus of claim 4 wherein the centralizers and cap are a cast part.

10. The anode mounting apparatus of claim 2 wherein the metallic component is a steel core, wherein the handle is steel and part of said core.

11. The anode mounting apparatus of claim 2 wherein the handle is part of the non-metallic cap.

12. An anode mounting apparatus that is configured to attach to a selected vessel that is to be protected from corrosion, wherein the vessel has a vessel wall and a vessel interior, comprising:

a) a reusable anode cap that includes a non-metallic portion;
b) an anode body;
c) a metallic component affixed to and imbedded in said cap non-metallic portion, so that when the anode cap is separated from the anode body, the metallic component remains imbedded in the anode cap;

d) wherein said metallic component has a first metallic connecting portion;

e) wherein said anode body removably connects to the first metallic connecting portion of said metallic component;

f) said metallic component having a second metallic connecting portion that forms a connection between the metallic component and the vessel wall; and g) said second metallic connecting portion enabling electrical connection to:

a shunt for current or voltage monitoring; and a resistor for regulation of anode current or voltage output.

13. The anode mounting apparatus of claim 12 wherein the anode is removably connectable to said metallic component at said first metallic connecting portion with a threaded fastener.

14. The anode mounting apparatus of claim 12 wherein the cap has a periphery with a cap annular flange and further comprising a clamp that secures the cap to the vessel by connecting to said cap annular flange.

15. The anode mounting apparatus of claim 14 wherein the selected vessel has an annular vessel flange, wherein said clamp connects the cap annular flange to the annular vessel flange.

16. The anode mounting apparatus of claim 12 wherein the cap has a cap width or diameter and further comprising a generally U-shaped handle connected to the cap at first and second spaced apart positions and wherein said handle extends over a majority of said cap width or diameter.

17. The anode mounting apparatus of claim 16 wherein the handle is part of the metallic component.

18. The anode mounting apparatus of claim 2 wherein the cap and handle are both of a non-metallic material.

19. The anode mounting apparatus of claim 12 further comprising a plurality of centralizers that extend along the anode.

20. The anode mounting apparatus of claim 19 wherein the centralizers are non-metallic.

21. The anode mounting apparatus of claim 19 wherein the centralizers are reusable.

22. A vessel sacrificial anode and head cover apparatus, comprising:

a) an anode body for protecting a vessel from corrosion, the vessel having an interior, the anode body having a length, a top end that extends beyond the interior of the vessel when installed in the vessel, a bottom end that is encased within the vessel when installed in the vessel, and wherein said body extends between the top and bottom ends; and b) an anode cover;

c) wherein the anode cover is removably attachable to the top end of the anode body;

d) wherein upon corrosion of the anode body, the anode cover can be removed and reused on a replacement new anode body; and e) said anode cover including a non-metallic cap and a metallic component imbedded within said non-metallic cap, so that when the anode cover is separated from the anode body, the metallic component remains imbedded in the anode cover; and f) wherein said metallic component has a metallic connecting portion that enables a removable connection to be made with said anode body top end.

23. The sacrificial anode and head cover apparatus of claim 22 wherein the anode head cover further comprises anode head extensions, wherein the extensions extend from the head cover beyond the top end of the anode down the anode body length into the vessel.

24. The sacrificial anode and head cover apparatus of claim 23 further comprising a handle attached to the anode cover opposite from the anode head extensions.

25. The sacrificial anode and head cover apparatus of claim 24 wherein the handle is attached to the anode cover via a handle attachment bar, nuts, and bolts.

* * * * *